US010213703B2

(12) United States Patent
Faecher

(10) Patent No.: US 10,213,703 B2
(45) Date of Patent: Feb. 26, 2019

(54) VIEWING INSTRUMENT FOR A TOY GUN

(71) Applicant: Bradley S. Faecher, Sudbury, MA (US)

(72) Inventor: Bradley S. Faecher, Sudbury, MA (US)

( * ) Notice: Subject to any disclaimer, the term of this patent is extended or adjusted under 35 U.S.C. 154(b) by 30 days.

(21) Appl. No.: 15/292,566

(22) Filed: Oct. 13, 2016

(65) Prior Publication Data

US 2018/0104613 A1 Apr. 19, 2018

(51) Int. Cl.

| | |
|---|---|
| ***A63H 33/22*** | (2006.01) |
| ***A63H 33/30*** | (2006.01) |
| ***A63H 5/04*** | (2006.01) |
| ***F41G 1/34*** | (2006.01) |
| ***F41G 1/46*** | (2006.01) |
| ***F41B 11/89*** | (2013.01) |

(52) U.S. Cl.

CPC ..... *A63H 33/22* (2013.01); *A63H 5/04* (2013.01); *A63H 33/30* (2013.01); *F41B 11/89* (2013.01); *F41G 1/345* (2013.01); *F41G 1/46* (2013.01)

(58) Field of Classification Search

CPC ..... A63H 33/22; A63H 33/30; A63H 5/04; F41G 1/345; F41G 1/46; F41B 11/89

USPC ..... 446/175; 42/79, 113, 122, 123, 140, 144

See application file for complete search history.

(56) References Cited

U.S. PATENT DOCUMENTS

| | | | | |
|---|---|---|---|---|
| 4,786,966 | A * | 11/1988 | Hanson | F41G 3/165 224/181 |
| 4,804,843 | A * | 2/1989 | Hall | F41G 3/165 250/330 |
| 6,608,720 | B1 * | 8/2003 | Freeman | G02B 27/4205 359/368 |
| 8,887,615 | B2 * | 11/2014 | Kim | F41A 19/21 89/1.41 |
| 2013/0199074 | A1 * | 8/2013 | Paterson | F41G 1/38 42/122 |

* cited by examiner

*Primary Examiner* — Vishu K Mendiratta

(57) ABSTRACT

A viewing instrument has an optical module having a first light pathway for conveying visible light reflected from an object to an eye of a user viewing the object; a thermal radiation detecting module having a thermal radiation detector adapted to detect thermal radiation emitted from the object being viewed to thereby generate one or more signals; an aiming module having at least one visible light-emitting member electrically connected with the thermal radiation detecting module, wherein the aiming module is adapted to receive the one or more generated signals from the thermal radiation detecting module, and in response to the received one or more signals, project a visible mark along the first light pathway to the eye of the user. The invention also provides a toy gun having the viewing instrument as described above.

18 Claims, 6 Drawing Sheets

VIEWING INSTRUMENT FOR A TOY GUN

FIELD OF THE INVENTION

The invention relates to a viewing instrument for use in a toy and, particularly, but not exclusively, to a viewing instrument for use in a toy gun.

BACKGROUND OF THE INVENTION

Toy guns of various types are available in the market. Particularly, toy guns have been designed with both decorative and functional features in order to mimic the appearance, operation as well as a user's experience of real guns. For example, toy guns such as toy rifles have been developed with components to simulate the appearance and/or function of telescopic sights. Various features have also been incorporated into traditional toy gun aiming arrangements to enhance the user's experience.

Objects of the Invention

An object of the present invention is to provide a viewing instrument for a toy gun.

Another object of the present invention is to provide a toy gun with novel viewing features for an improved user's experience.

A further object of the present invention is to mitigate or obviate to some degree one or more problems associated with known toy guns, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a viewing instrument. The viewing instrument comprises an optical module having a first light pathway for conveying visible light reflected from an object to an eye of a user viewing the object; a thermal radiation detecting module having a thermal radiation detector adapted to detect thermal radiation emitted from the object being viewed to thereby generate one or more signals; an aiming module having at least one visible light-emitting member electrically connected with the thermal radiation detecting module; wherein the aiming module is adapted to receive the one or more generated signals from the thermal radiation detecting module, and in response to the received one or more signals, to project a visible mark along the first light pathway to the eye of the user.

In a second main aspect, the invention provides a toy gun comprising the viewing instrument according to the first main aspect.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
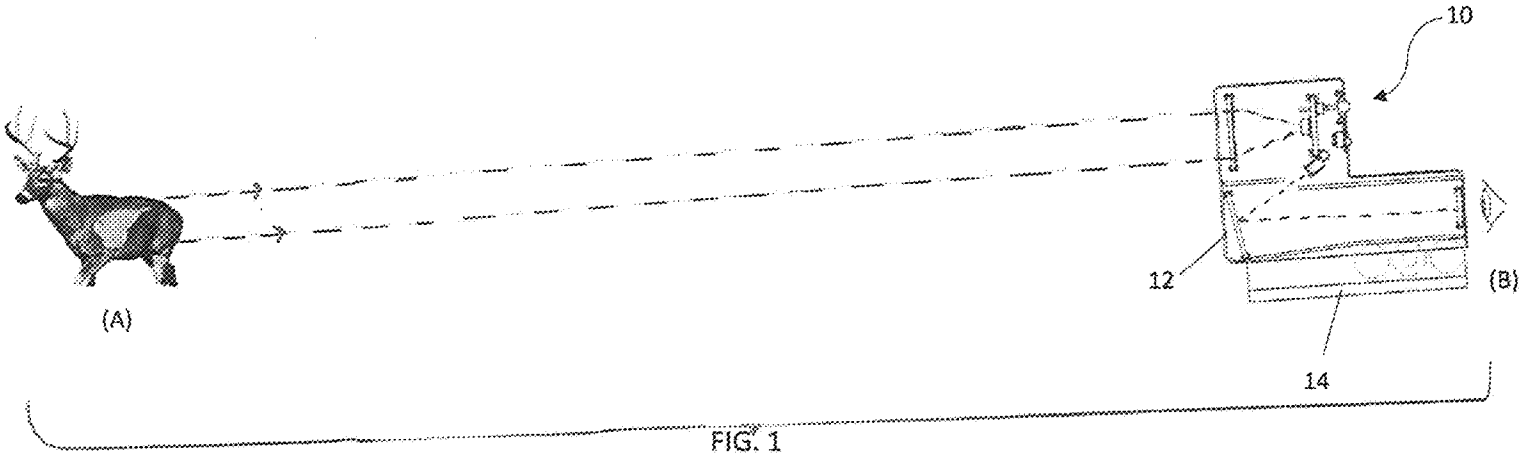
FIG. 1 shows the use of a viewing instrument according to an embodiment of the present invention for viewing an object.
Figure 2:
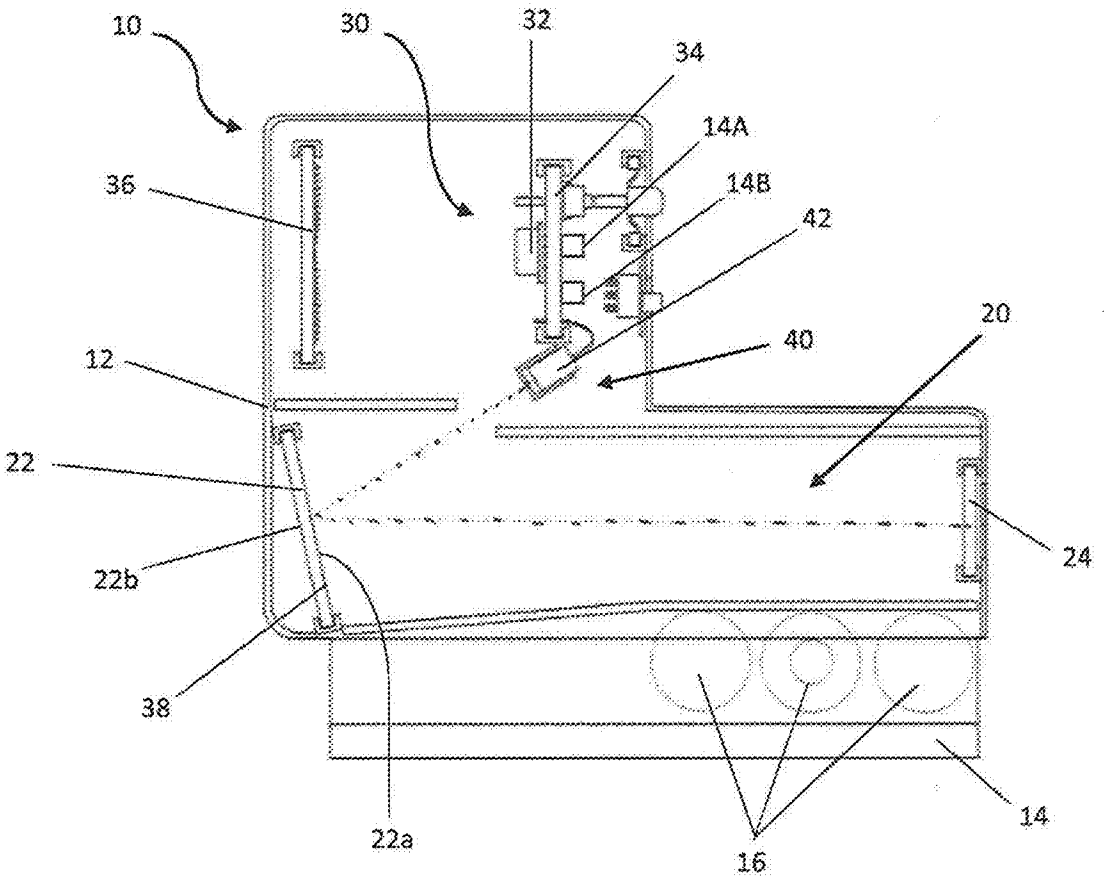
FIG. 2 is a side, internal view of the viewing instrument of FIG. 1.

Referring to FIGS. 1 and 2, shown is an embodiment of a viewing instrument 10 according to the present invention. The viewing instrument 10 may comprise a number of different modules including an optical module 20, a thermal radiation detecting module 30, and an aiming module 40 arranged at or encased by a housing 12 of the viewing instrument 10. The thermal radiation detecting module 30 and the aiming module 40 can be electrically connected via a printed circuit board (PCB) 34 which controls operation of the electronic components of the instrument 10. The instrument 10 can be powered by any suitable power sources, such as a battery 16 provided at the housing 12. The bottom portion of the housing 12 may optionally be configured with a mount 14 for mounting the instrument 10 at a substrate, such as an upper portion of a toy gun via a rail, for example. The PCB may include a processor 14A for executing machine readable instructions and a memory 14B for storing such instructions, said instructions being configured to implement at least a method of processing thermal radiation in accordance with the invention. The memory 14B is preferably a non-transitory memory device such as a non-transitory computer readable medium. The processor may comprise a dedicated processor chip mounted on the PCB 34 for controlling any one or more of the optical module 20, the thermal radiation detecting module 30, and the aiming module 40. In some embodiments, the processor may be comprised in a general processor 14A configured to control some or all operations of the instrument 10.

More specifically, the optical module 20 may comprise a first light pathway for conveying visible light reflected from an object (A) to an eye (B) of a user viewing the object (A). The object (A) can be any life form such as a human being, an animal or a plant; and/or a non-living object. Preferably, the optical module 20 comprises a lens 22 for focusing visible light reflected from the object (A) onto an eyepiece 24 arranged at an end of the first light pathway, although in some embodiments a focusing lens is not essential.

The thermal radiation detecting module 30 may comprise a thermal radiation detector 32 adapted to detect thermal radiation, and preferably, thermal infrared (IR) radiation, emitted from the object (A) to thereby generate one or more output signals. The thermal radiation detecting module 30 may preferably comprise at least a first lens member 36 adapted to focus the thermal IR radiation emitted from the object (A) to the thermal radiation detector 32. In one specific embodiment, the first lens member 36 is preferred to be a compact lens such as a Fresnel lens, which allows a relatively large aperture and a short focal length for focusing the emitted radiation within a relatively confined spatial arrangement. Focusing the thermal radiation has at least the advantage of reducing the sensitivity required of the thermal radiation detector and thereby enabling a less expensive detector to be employed.

The aiming module 40 may comprise at least one visible light-emitting member 42 electrically connected with the thermal radiation detecting module 30 either directly or via the processor. Particularly, the aiming module 40 is adapted to receive the one or more signals generated from the thermal radiation detecting module 30, and in response to the received signals, project a visible mark along the first light pathway of the optical module 20 to the eye (B) of the user. In one embodiment, the visible mark is arranged to be projected off axis from focus towards a tilted reflecting member 38 such as, but not limited to, a mirror and more particularly, a concave mirror, and subsequently, be reflected by the reflecting member 38 along the first light pathway to reach the eye (B) of the user. In one further embodiment as shown in FIG. 2, the reflecting member 38 can be provided in the form of a lens, such as the lens 22 of the optical module 20 capable of focusing the reflected visible light from the object (A) onto the eyepiece 24. In this configuration, a rear surface 22*a* of the lens acts as the reflector such as in the form of a reflective surface 38 at said rear surface 22*a* of the lens 22 to thereby allow reflection of the projected visible mark along the first light pathway. The reflective rear surface 22*a* can also be provided in the form of a reflective film or coating 38 arranged at the rear surface 22*a* of the lens 22, whereby said reflective film does not substantially reduce the light transmission quality of the lens 22 for visible light impinging on a front surface 22*b* of the lens 22 and passing through said lens 22 along the first light pathway.

Preferably, the at least one visible light-emitting member 42 may comprise one or more light-emitting diodes (LEDs) adapted to emit light in one or more colors, although any other suitable lighting means may also be applicable as long as it is capable of generating visible light in one or more colors at sufficient contrasts and intensities. In one embodiment, the at least one visible light emitting member 42 can be arranged to emit light of one or more colors, for example, red, green and/or blue, in response to the one or more generated signals received from the thermal radiation detecting module 30, such that the projected visible mark comprises the one or more colors of the red, green and/or blue as a consequence. More preferably, the at least one visible light emitting member 42 is adapted to emit light with a change of color from at least a first color to at least a second color, for example, from a color green to a color red, and then from a color red to a color blue, etc. in response to a change of the generated signals as received from the thermal radiation detecting module 30, such that the color of the projected visible mark is changeable accordingly when being viewed from the eyepiece 24 by the user.

Figure 3:
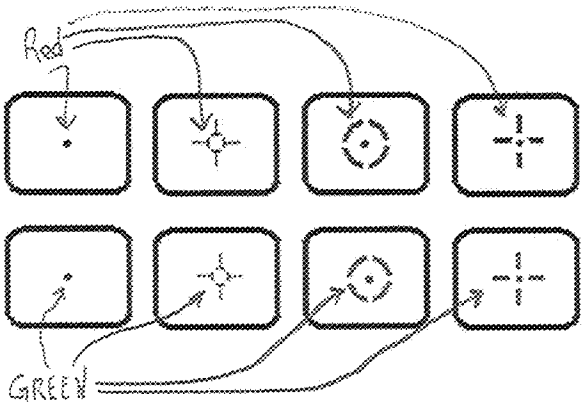
FIG. 3 shows a number of different embodiments of reticle marks in the color red and green projectable onto an image as viewed by the user via the viewing instrument of FIG. 1.

The visible mark can be generated by arranging a mark-carrying aperture or a filter in front of the respective light-emitting diodes (LEDs). Particularly, a light beam emitted from the light-emitting diode (LED) may pass through the aperture or the filter and be projected as a visible mark having various designs, patterns or shapes. Such visible marks can be utilized as a reticle for aiming the object (A) when viewed via the optical module 20 of the instrument 10. For example, the visible mark may comprise one or more fine lines, circles, arrows or dots in different colors, as shown in FIG. 3, such that the mark can be used to indicate position of a viewed target and, at the same time, represent thermal IR information of the viewed target based on the radiation signals received from the thermal radiation detecting module 30.

Figure 4:
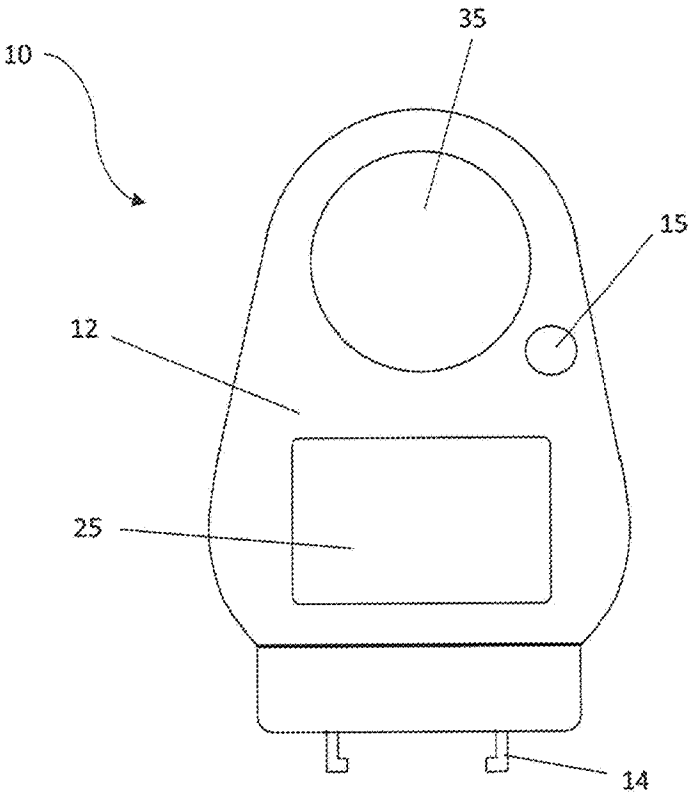
FIG. 4 is a front view of the viewing instrument of FIG. 1.
Figure 5:
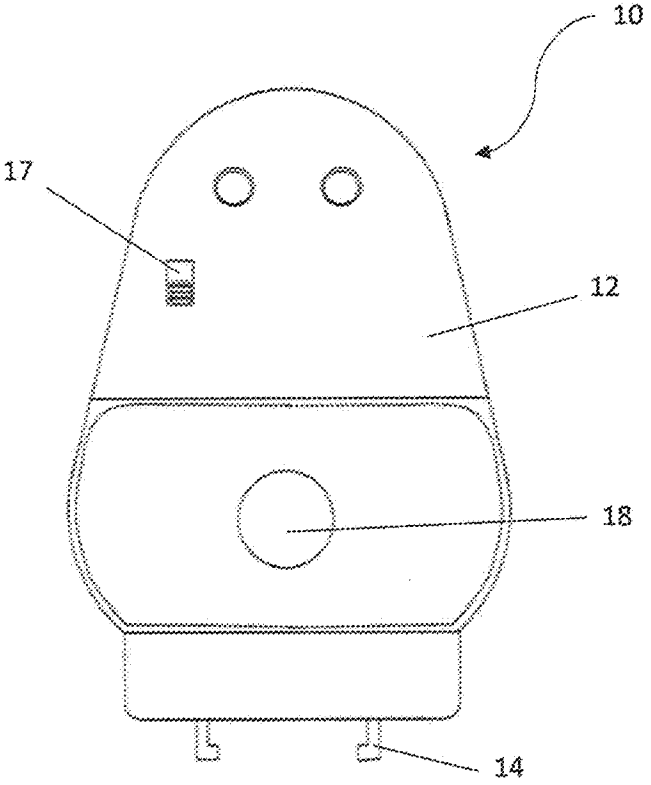
FIG. 5 is a rear view of the viewing instrument of FIG. 1.

FIGS. 4 and 5 show a front view and a rear view, respectively, of the housing 12 of the viewing instrument 10. Specifically, the front side of the housing 12 can be provided with a first inlet 25 of the optical module 20 arranged at the first light pathway for receiving the visible light reflected from the object (A). The front side can further be provided with a second inlet 35 of the thermal radiation detecting module 30 for receiving the thermal radiation emitted from the object (A). A viewing aperture 18 and/or one or more control buttons such as a main switch 17 can also be arranged at the rear side of the housing 12.

Preferably, the instrument 10 may further comprise a sensor 15 such as a light sensor and/or a temperature sensor arranged at an exterior of the housing 12 for detecting ambient light and/or temperature conditions. The sensor 15 may comprise, for example, a photo resistor 15 arranged at the front side of the housing 12 and electrically connected with the thermal radiation detector 32. The light sensor 15 is capable of generating a signal based on the ambient light condition, and such that the generated signal can be utilized by one or more controllers, e.g. the processor, of the PCB 34 for controlling operation of the thermal radiation detector 32, for example, to disable operation of or to switch off the thermal radiation detector 32 when the detected light intensity has exceeded a certain, predetermined threshold.

Figure 6:
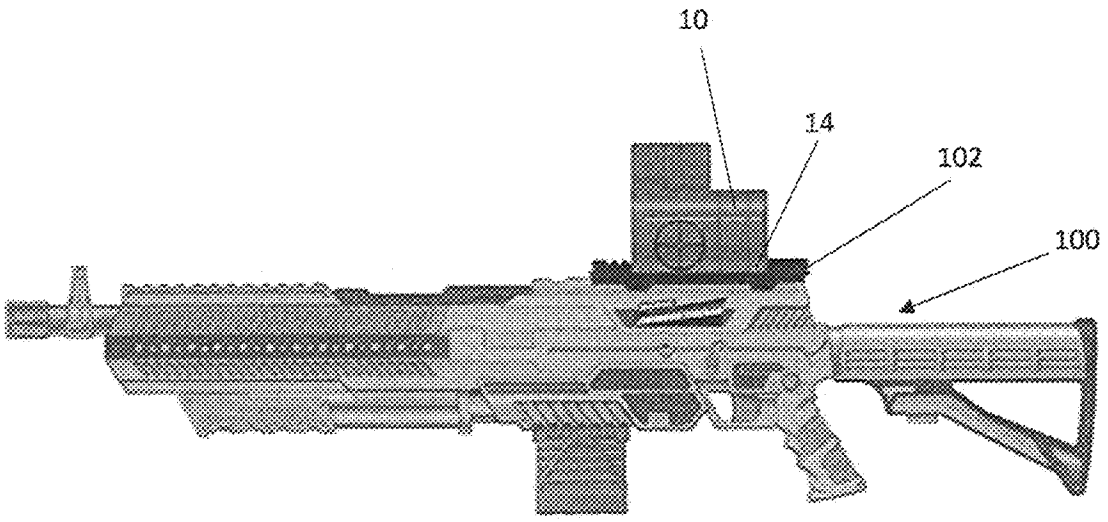
FIG. 6 shows an embodiment of a toy gun mounted with the viewing instrument of FIG. 1.

Referring to FIG. 6, shown is one exemplified application of the instrument 10 which illustrates a toy gun 100 being mounted with the viewing instrument 10. In this embodiment, the instrument 10 can be releasably and/or movably mounted on the toy gun 100 via a rail 102, for example. To begin a shooting and/or aiming game using the toy gun 100, the user may first switch on the main switch 17 at the rear side of the instrument 10 to allow the sensor 15 to detect the ambient light intensity and/or temperature to thereby establish a reference ambient condition. For example, at a typical, indoor lighting condition, the sensor 15 will enable the thermal radiation detector 32 to detect any thermal IR radiation received via the second inlet 35, and for the instrument 10 to enter a standby, operating mode. In one embodiment, the light emitting diode of the visible light-emitting member 42 can be arranged to emit light in a first color, such as a green color, so as to project a green color mark visible by the user at the standby condition. The green mark will appear as a green colored reticle overlapping the background view when observed by the user. In one embodiment, the green light may further be arranged to flash discontinuously to provide a blinking effect to the green mark on the viewed image to thereby indicate the standby condition of the instrument 10.

When the instrument 10 is directed to point towards an object ($A_1$) to thereby allow the object ($A_1$) to be viewed and aimed at by the user as a target, and that the thermal IR radiation from the object ($A_1$) is detected to be above a predetermined thermal radiation threshold ($T_{ref}$), a signal will be generated by the thermal radiation detector 32 to thereby trigger the light-emitting member 42 to emit light continuously in a different color, such as a red color. A steady red colored reticle will then be generated and be projected onto the image of the object ($A_1$) as viewed by the user from the eyepiece 24. The red colored reticle is indicative that the object ($A_1$) being viewed may comprise a living object, such as a human being and/or an animal.

However, when the instrument 10 is then redirected to face another object ($A_2$), and that the thermal IR radiation from the object ($A_2$) is detected to be at or below the predetermined thermal radiation threshold ($T_{ref}$), a different signal will be generated by the thermal radiation detector 32 to thereby trigger the light-emitting member 42 to emit, for example, a continuous green light. A steady green colored reticle will then be projected onto the image of the object ($A_2$) as viewed by the user. The green colored reticle is indicative that the object ($A_2$) being viewed may comprise a non-living object.

As soon as the toy gun 100 and/or the instrument 10 is arranged to point away from a living object ($A_1$) to a non-living object ($A_2$) or a background object, the drop in the detected thermal IR radiation will trigger the LED of the light-emitting member 42 to change color of the emitted light from red to green, or vice versa. Consequently, a change in the color of the reticle as observed by the user from the eyepiece 24 indicates the change of thermographic information of the viewed target. This simulates the effect of traditional thermographic cameras, which detect IR radiation of the object and subsequently, display computer generated, thermographic images based on the physiological conditions such as temperature of the object using a screen.

In one embodiment, if the thermal radiation detector 32 fails to detect any variations in thermal IR radiation for a set period of time, for example, for more than 5 minutes continuously, this may be an indication that the toy gun 100 and/or the instrument 10 has not been used by the user and thus been kept idle for a period of time. Once this "idling" of the instrument 10 is detected, the PCB 34 connected with the thermal radiation detector 32 may be adapted to automatically switch off the power supply to thereby save power and also, prolong the lifespan of the electronic components such as the light-emitting diodes. The user may use the main power switch 17 or a reset button provided at the housing 12 to resume operation of instrument 10.

If the instrument 10 is exposed to an excess level of sunlight, the sensor 15 will generate a further signal to the PCB 34 to temporarily disable the thermal radiation detector 32. Operation of the detector 32 can be resumed when the exposure to excess sunlight, as detected by the sensor 15, is interrupted, for example, when the toy gun 100 is being moved back to an indoor environment. Alternatively, the detection of excess sunlight by the sensor 15 may trigger the light-emitting member 42 to emit light of a different, third color, such as a blue color to thereby indicate an abnormal operating condition to the user. Both of these mechanisms are useful in avoiding detection of false positive thermal radiation signatures, e.g. falsely suggesting that the viewing instrument is aimed at a living thing rather than a heavily sunlit inanimate object.

The viewing instrument according to the present invention is advantageous in that it provides a relatively simple and low cost technical solution to simulate the effect of a thermal infrared radiation detecting or imaging scope. Particularly, the viewing instrument is mountable on a toy gun to mimic the viewing effect of a telescopic sight of, for example, a rifle gun, and at the same time, allows detection of the thermal infrared radiation as emitted from the viewed object. Based on the detected infrared signal, the viewing instrument is then adapted to display a reticle in different colors in response to the detected change in thermal infrared radiation. The change of color in the displayed reticle is thus indicative of the infrared thermographic information of the viewed object, for example, whether it is a living or a non-living object, to thereby significantly enhance the user's experience of the toy gun.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such prior art does not constitute an admission that the prior art forms a part of the common general knowledge in the art.

The invention claimed is:

1. A viewing instrument for a toy, comprising:

an optical module having a first light pathway for conveying visible light reflected from an object to an eye of a user viewing the object;

a thermal radiation detecting module having a thermal radiation detector adapted to detect thermal radiation emitted from the object being viewed to thereby generate one or more signals;

an aiming module having at least one visible light-emitting member electrically connected with the thermal radiation detecting module for receiving the one or more generated signals;

wherein the at least one visible light-emitting member of the aiming module is adapted to emit light of at least a first color in response to a first generated signal of the one or more generated signals, and to emit light of at least a second color in response to a second generated signal of the one or more generated signals, the emitted light of at least the first or the second color is arranged to pass through a mark-carrying filter provided in front of the at least one visible light-emitting member, such that a visible mark having a shape corresponds to the mark carried by the filter and comprising the respective color is projected along the first light pathway to the eye of the user to indicate information based on the detected thermal radiation of the object being viewed.

2. The viewing instrument according to claim 1, wherein the visible mark comprises a reticle having one or more fine lines, circles, arrows and dots to indicate position of the object being viewed.

3. The viewing instrument according to claim 1, wherein the at least one visible light emitting member of the aiming module is adapted to emit light with a change of color from at least the first color to at least the second color in response to a change of the generated signals received from the thermal radiation detecting module, such that color of the projected visible mark is changed from at least the first color to at least the second color.

4. The viewing instrument according to claim 1, wherein the thermal radiation detecting module comprises at least a first lens member adapted to focus the thermal radiation emitted from the object being viewed to the thermal radiation detector.

5. The viewing instrument according to claim 4, wherein the first lens member comprises a fresnel lens.

6. The viewing instrument according to claim 1, wherein the thermal radiation detector detects thermal infrared radiation being emitted from the object being viewed.

7. The viewing instrument according to claim 1, wherein the at least one visible light-emitting member comprises one or more light-emitting diodes adapted to emit light of one or more colors.

8. The viewing instrument according to claim 1, wherein the optical module comprises a lens for focusing visible light reflected from the object onto an eyepiece arranged at an end of the first light pathway.

9. The viewing instrument according to claim 8, wherein a rear surface of the lens is arranged to reflect the projected visible mark along the first light pathway to the eye of the user.

10. The viewing instrument of claim 9, wherein the rear surface of the lens is provided with a reflective film whereby said reflective film does not substantially reduce the light transmission quality of the lens for visible light impinging on a front surface of the lens and passing through said lens along the first light pathway.

11. The viewing instrument according to claim 1, wherein the aiming module comprises a reflecting member for reflecting the projected visible mark along the first light pathway to the eye of the user.

12. The viewing instrument according to claim 1, further comprising a light sensor arranged at an exterior of the instrument for detecting ambient light intensity, the light sensor being adapted to electrically connect with the thermal radiation detector.

13. The viewing instrument according to claim 12, wherein a signal from the ambient light sensor is utilised by a controller to control operation of the thermal radiation detector.

14. The viewing instrument according to claim 1, further comprising a first inlet at the optical module arranged at the first light pathway adapted to receive the visible light reflected from the object.

15. The viewing instrument according to claim 1, further comprising a second inlet at the thermal radiation detecting module adapted to receive the thermal radiation emitted from the object.

16. The viewing instrument according to claim 1, further comprising a mount for mounting the instrument at a substrate.

17. A toy gun comprising the viewing instrument according to claim 1.

18. The toy gun according to claim 17, wherein the viewing instrument is releasably mountable on the toy gun.

* * * * *